United States Patent [19]

Brundritt

[11] Patent Number: 4,996,936

[45] Date of Patent: Mar. 5, 1991

[54] EMERGENCY FLOATATION DEVICE FOR WATERCRAFT

[75] Inventor: Larry W. Brundritt, Willowdale, Canada

[73] Assignee: 824328 Ontario Limited, Willowdale, Canada

[21] Appl. No.: 350,287

[22] Filed: May 11, 1989

[51] Int. Cl.[5] ..... B63C 9/04

[52] U.S. Cl. ..... 114/68; 114/123

[58] Field of Search ..... 441/40; 114/68, 69, 114/123, 219, 345, 348, 360

[56] References Cited

U.S. PATENT DOCUMENTS

| | | | |
|---|---|---|---|
| 1,220,876 | 3/1917 | Moore | 114/360 |
| 2,924,192 | 2/1960 | Salvage | 114/68 |
| 3,822,662 | 7/1974 | Morita et al. | 114/68 |
| 3,952,350 | 4/1976 | Moucka | 114/68 |
| 4,817,555 | 4/1989 | Meinen | 114/360 |

FOREIGN PATENT DOCUMENTS

| | | | |
|---|---|---|---|
| 90/08691 | 8/1990 | PCT Int'l Appl. . | |
| 2184401 | 6/1987 | United Kingdom | 114/360 |

*Primary Examiner*—Sherman Basinger
*Assistant Examiner*—Stephen P. Avila
*Attorney, Agent, or Firm*—Arne I. Fors

[57] ABSTRACT

A buoyant support for a watercraft comprises a rigid, elongated support surface, and an inflatable member folded along its length in a substantially deflated condition to form a relatively compact, resilient mass secured to and overlaying the surface. A cover or the like retains the inflatable member in its folded, overlaying condition. In an emergency the inflatable member is inflated to provide the buoyant support. In the folded condition the device may act as a fender for the watercraft.

11 Claims, 4 Drawing Sheets

FIG.4.
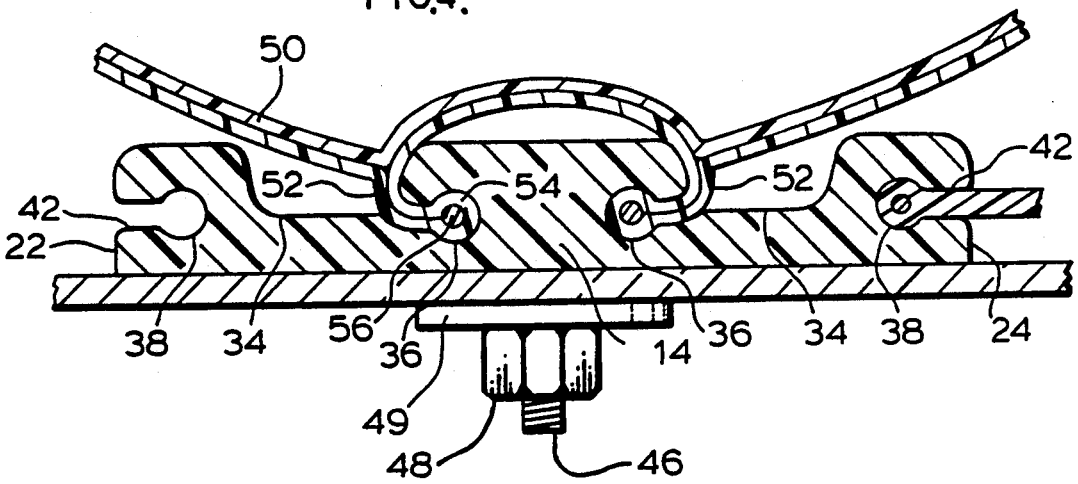
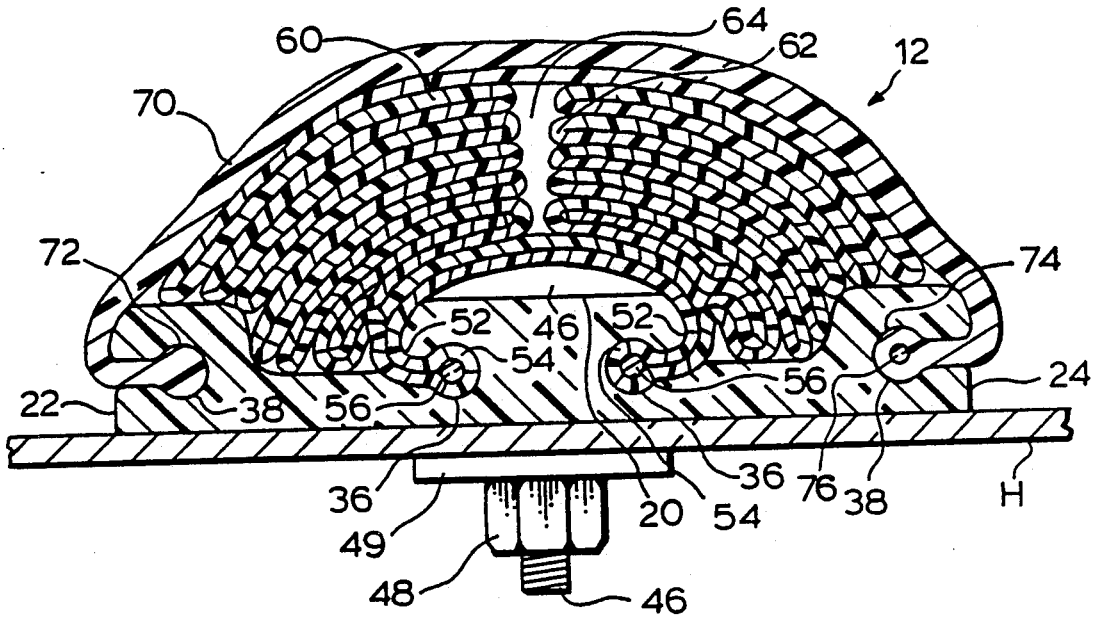
FIG.5.

EMERGENCY FLOATATION DEVICE FOR WATERCRAFT

FIELD OF INVENTION

This invention relates to buoyant supports. It particularly relates to buoyant supports of an inflatable type, which are normally stored in a compact, rugged deflated condition ready for deployment in emergencies. Such supports will find particular use in connection with watercraft, but it is contemplated that they will find use in connection with diverse objects that may require buoyant support in an emergency.

BACKGROUND OF INVENTION

Many devices have been heretofore contemplated for providing buoyant support to a watercraft. Devices of a broadly similar nature to those contemplated herein generally comprise elongated members which may be of the rigid, foam filled type, or which are inflated, and which are secured along the length thereof to the outside of the hull of the watercraft above the waterline.

A disadvantage of such devices is that in order to provide the requisite support for a foundered watercraft, they must be relatively large, and generally speaking they will have a diameter at least as large as that of a fender normally employed on a watercraft of a size on which such buoyant device is used. Accordingly, buoyant devices that are permanently inflated must be structured not only to perform the desired function of providing buoyancy in an emergency, but also to withstand use as fenders if they are to be durable. Moreover, both permanently inflated and foam filled buoyant support devices tend to drag in the water when the watercraft is under way, particularly where the watercraft has a low freeboard, or where heeled in the wind, thereby adversely affecting the performance of the watercraft.

Where the buoyant support device is permanently inflated or foam filled, it does not provide any visual indication that an emergency condition may exist, and other signalling means must be employed for this purpose.

SUMMARY OF THE INVENTION

It is a prime object of this invention to provide improvements to emergency buoyant devices.

It is a further object of the invention to provide a buoyant device which may be stored in an uninflated condition ready for easy deployment in an emergency.

It is another object of the invention to provide an emergency buoyant device which may find service as a fender for the watercraft when in its uninflated condition.

It is yet another object of the invention to provide a compact buoyant device for watercraft that has accordingly a reduced tendency to drag in the water.

It is still another object of the invention to provide a buoyant device that is readily deployed, but which is relatively protected from damage from forces to which watercraft are commonly exposed during day to day use, and which may therefore be relatively more lightly structured.

In accordance with one aspect of the invention, an emergency buoyant support for a watercraft comprises a rigid elongated support surface, which may form part of the hull of the watercraft, or which may be separate therefrom and secured thereto, or indeed to other parts thereof to which buoyant support may be desirable. The device further includes an elongated inflatable member secured along its length to the support surface. A particular characterizing feature of the invention is that the inflatable member is folded along its length, in a substantially deflated condition, so as to form a relatively compact mass overlaying the support surface, and means is provided to retain the inflatable member in the folded condition.

Desirably, the retaining means releases the inflatable member from this folded condition automatically upon the inflation thereof.

Preferably, the means for securing the inflatable member to the support surface is substantially continuous along the length of the inflatable member. Conveniently, such means comprises one or more flaps integrally secured to the inflatable member and anchored to the support surface.

In accordance with the preferred embodiment of the invention, the securing means includes a pair of transversely spaced apart flaps having bulbous ends rooted in a pair of grooves formed in or on the support surface.

Suitably, the inflatable member is folded along the length thereof in serpentine fashion, from transversely opposed sides thereof, so as to leave a central air space running substantially along the length of the folded inflatable member, into which air space there is connected a hose for inflating the inflatable member, thereby facilitating gas transfer from a container locating externally to the inflatable member in which gas may be stored under pressure, and the rapid deployment of the emergency device.

It will be appreciated that while the term "buoyant support" is used in the singular, it will usually be desirable to limit the axial extent of the inflatable member, if only from a manufacturing and handling standpoint, whereby two or more devices will normally be secured to a watercraft.

Preferably the means for retaining the inflatable member in its folded condition will comprise a tough, relatively inextensible cover, whereby the device may also find service as a fender for the watercraft. Since the cover protects the inflatable member from damage likely to be caused by forces to which the watercraft is exposed during normal service, the inflatable member may be more lightly structured, in comparison to those devices where the inflatable member is at all times fully exposed and called upon to perform double duty as a fender.

Preferably, the inflatable member will have indicia on the surface thereof that will give a clear visual indication when the member is inflated that an emergency situation exists. Such indicia will be substantially concealed when the inflatable member is folded in its non-inflated condition.

These foregoing objects and aspects of the invention, together with other objects, aspects and advantages thereof will be more apparent from the following description of a preferred embodiment thereof, taken in conjunction with the following drawings.

BRIEF DESCRIPTION OF THE DRAWINGS

FIG. 4 is a cross section on 4—4 of FIG. 2, and

FIG. 5 is a similar cross section to FIG. 4, but showing the buoyant device in its folded condition ready for deployment.

DESCRIPTION OF THE PREFERRED EMBODIMENT

Figure 1:
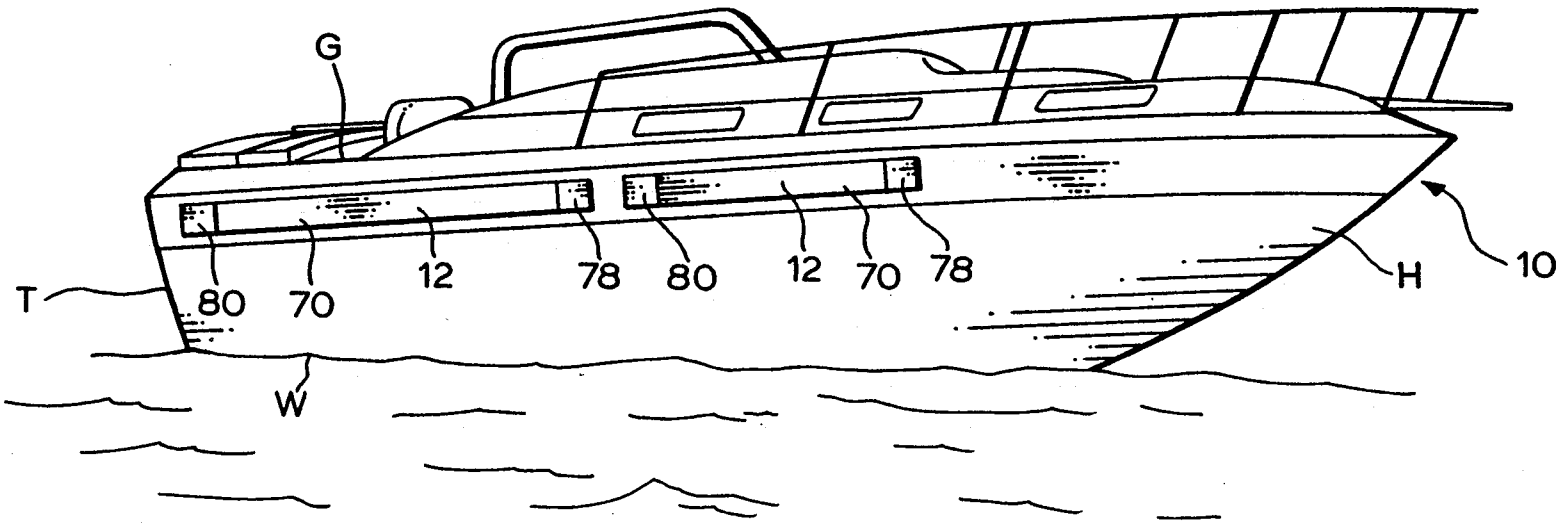
FIG. 1 shows in perspective view a watercraft to which the flotation device of the invention is fitted, ready for deployment in an emergency.
Figure 2:
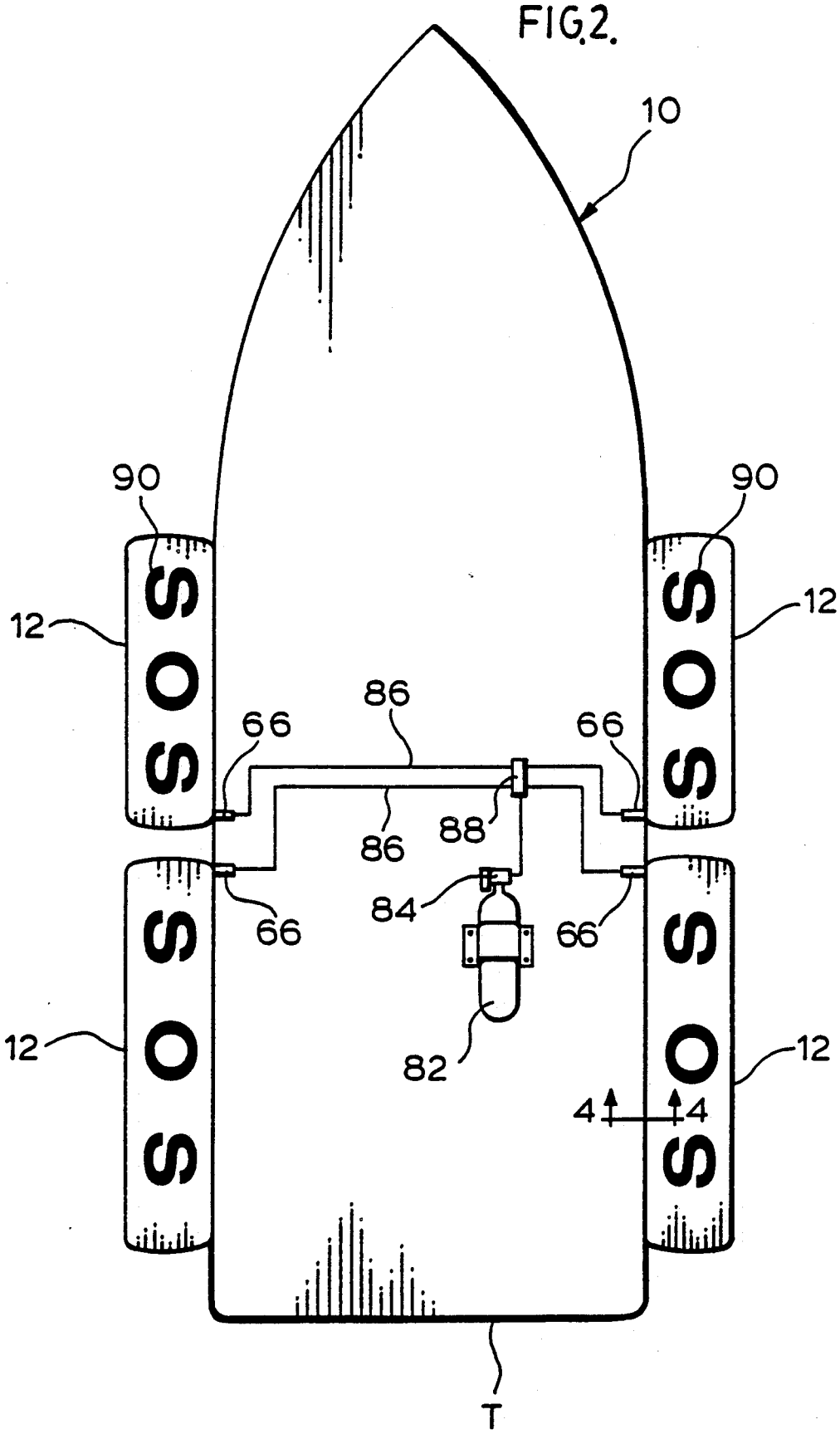
FIG. 2 is a plan view from above in schematic form of the watercraft of FIG. 1 showing the flotation device deployed and a system for its rapid deployment, in schematic form.
Figure 3:
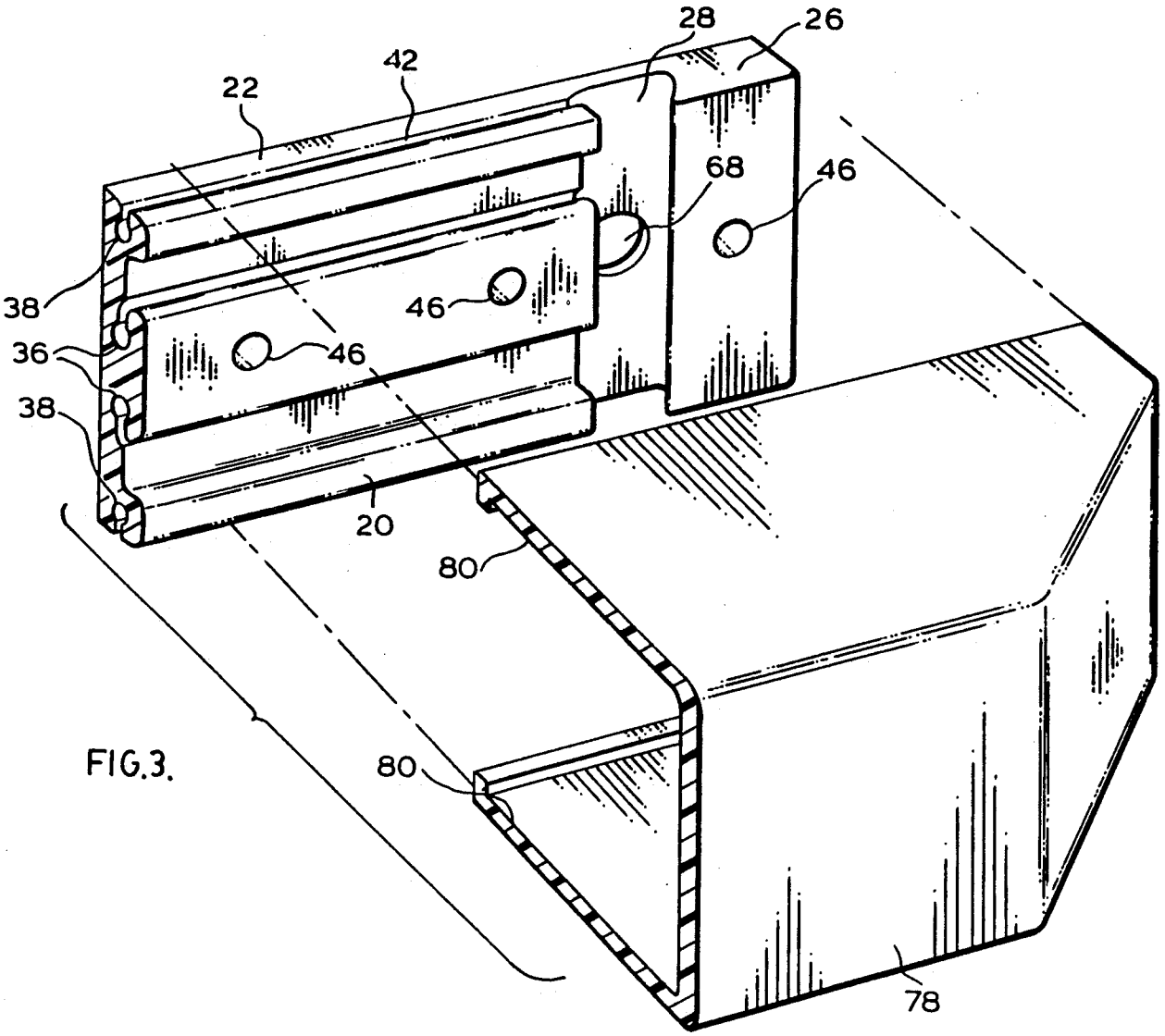
FIG. 3 shows in perspective, exploded view on enlarged scale a component part of the buoyancy device of the invention.

Referring to the drawings in detail, an exemplary boat with which the buoyant device of the invention may be used is denoted generally therein by the numeral 10. Boat 10 has a waterline W, hull H, gunwales G, transom T. A pair of buoyant devices 12 in accordance with the invention are secured to both the port and starboard sides of hull H adjacent gunwales G.

Buoyant device 12 comprises a rigid, axially extending plate 14 having a rear face 18, support surface 20, transverse sides 22, 24 and end portions 26, one end portion 26 having a relatively deep channel 28 in forward surface 20. Front surface 20 is provided with a pair of parallel axially extending wells 34 therealong, and at the bottom of each well a bulbous slot 36, the slots and wells being in communication with trnasverse channel 28 at an end 26 of plate 14. Transverse sides 22, 24 each have an axially extending bulbous groove 38 therein, the grooves each having an outwardly opening entrance thereto respectively identified as 42. Wells 34, slots 36 and grooves 38 each communicate with channel 28. Plate 14 is secured to hull H by means of bolts 46 located at intervals along each plate, using nuts 48 and washers 49.

Buoyant device 12 further comprises an elongate inflatable bladder 50. Bladder 50 is provided with a pair of flaps 52 generally coextensive therewith, each flap being welded along one edge thereof to the bladder to form a unitary structure therewith. The other (distal) edge 54 of each flap 52 has a bulbous cross section, and is reinforced with a wire core 56. Bladder 50 is retained on plate 14 by threading bulbous edges 54 in slots 36 from entry channel 28, thereby capturing edges 54.

Bladder 50 is folded along its length, upper portions of the bladder forming a first series of serpentine folds 60, and lower portions a similar series of serpentine folds 62, leaving a small air space 64 therebetween running the length of the uninflated bladder.

A hose 66 passes through aperture 68 in transverse channel 28 in plate 14 to connect to the interior of bladder 50, preferably in direct communication with air space 64 so as to facilitate the rapid transfer of air or other gas to and from bladder 50 along the length thereof.

Bladder 50 is desirably exhausted under moderate vacuum to facilitate the compaction of folds 60 and 62 at least during such time as a cover 70 is fitted over the folded bladder. Cover 70 has a relatively thick wall and may suitably be fabric or wire mesh reinforced to provide durability. The upper and lower edges of cover 70, respectively indicated as 72, 74, are bulbous, and are respectively received in grooves 38 by threading therealong from channel 28. Lower edge 74 of cover 70 is reinforced with a wire core 76, whereby it is not susceptible to being pulled out of groove 38 through the entrance 42 thereto. The upper edge 72 of cover 70 is not similarly reinforced, and upon inflation of bladder 50 the upper edge of the cover will deform sufficiently whereby it will squeeze through the entrance 42, to automatically release the cover along one edge only thereof.

The axial end portions 26 of plate 14 are each provided with a tough, resilient end cap 78 which is hollow at 80 to provide a cap for the somewhat irregular appearance of the folded axial ends of the bladder 50 and cover 70, and protect the axial ends by providing a relatively smooth transition thereto.

Means is desirably provided in boat 10 for the rapid deployment of buoyant devices 12. Such means are illustrated comprises a gas reservoir 82, an actuation valve 84, and gas distribution tubing 86 connecting valve 84 to hose 66, preferably through a non-return valve 88.

Suitably bladder 50 may be inflated to a small positive gas pressure following the fitting of cover 70, to enhance the performance of the buoyant devices 12 as fenders when in their folded, covered condition. Additionally, such partial inflation of bladder 50 will enlarge central air space 64 and serve to open up branch passages, thereby increasing the speed with which bladder 50 may be deployed in an emergency.

Bladder 50 is provided with indicia 90 thereon that will clearly serve as a warning signal to an observer that an emergency situation exists, and that assitance should be rendered. It will be appreciated that under manual, non-emergency situations bladder 50 will be folded to substantially conceal indicia 90, whereby a warning signal is not conveyed. This contrasts with those buoyant devices that are intended for use in a permanently inflated condition, where any such signal would always be visible.

It will be apparent that many changes may be made to the illustrative embodiment, while falling within the scope of the invention and it is intended that all such changes be covered by the claims appended thereto.

I claim:

1. An emergency buoyant support for a watercraft comprising: a rigid, elongated support surface; an elongated inflatable member normally folded along its length in a substantially deflated condition to form a relatively compact, resilient mass overlying and substantially co-extensive with said support surface, said inflatable member being folded in a serpentine formation along each transverse, side thereof to leave a central air distribution channel, means securing said inflatable member along the length thereof to said support surface, said securing means comprising at least one flap having transversely opposed edges, one said edge being integrated with said inflatable member, the other said edge being bulbous and said support surface being provided with a groove within which said bulbous edge is received to secure said flap to said support surface, means for inflating said inflatable member, and a cover for retaining said inflatable member in said folded condition, said cover having laterally spaced side edges each having a bulbous cross-section and said support surface having laterally spaced mating grooves for receiving and trapping said bulbous side edges to secure the cover to the support surface, the side edges of the cover and said grooves of the support surface being respectively configured so as to preferentially release the cover along one side thereof upon inflation of the inflatable member.

2. An emergency bouyant support as defined in claim 1, wherein said bulbous edge has a reinforcing wire core.

3. An emergency buoyant support as defined in claim 2, wherein said means for securing said inflatable member to said support surface includes a second flap similar to said one flap and transversely spaced therefrom.

4. An emergency buoyant support as defined in claim 1, wherein said support surface is a plate, and further comprising means for securing said plate to said watercraft.

5. An emergency buoyant support as defined in claim 1, wherein said inflatable member bears warning indicia on the surface thereof, and wherein said indicia is substantially concealed when said inflatable member is in said folded condition.

6. A watercraft including a hull having a waterline and gunwales along opposite sides of said hull, at least one emergency buoyant device secured to each side of the hull on the outside of the hull above the waterline and adjacent the gunwales, each said buoyant device comprising: a rigid, elongated support surface; an elongated inflatable member normally folded along its length in a substantially deflated condition to form a relatively compact, resilient mass overlying and substantially co-extensive with said support surface, said inflatable member being folded in a serpentine formation along each transverse side thereof to leave a central air distribution channel, means securing said inflatable member along the length thereof to said support surface, said securing means comprising at least one flap having transversely opposed edges, one said edge being integrated with said inflatable member, the other said edge being bulbous and said support surface being provided with a groove within which said bulbous edge is received to secure said flap to said support surface, means for inflating said inflatable member, and a cover for retaining said inflatable member in said folded condition, said cover having laterally spaced side edges each having a bulbous cross-section and said support surface having laterally spaced mating grooves for receiving and trapping said bulbous side edges to secure the cover to the support surface, the side edges of the cover and said grooves of the support surface being respectively configured so as to preferentially release the cover along one edge thereof upon inflation of the inflatable member.

7. A watercraft as defined in claim 6, wherein said means for inflating said inflatable member includes a reservoir of compressed gas.

8. A watercraft as defined in claim 6, wherein said cover for retaining said inflatable member in said folded condition comprises a tough, generally inextensible plastic material, whereby said device is said folded, deflated, covered condition will serve as a durable fender for said watercraft.

9. A watercraft as defined in claim 6, wherein said means for inflating said inflatable member includes a gas entry tube connected in flow relationship with central gas distribution source.

10. A watercraft as defined in claim 6, wherein said inflatable member is secured to said hull by means including flaps integral with said inflatable member.

11. An emergency buoyant support as defined in claim 6, wherein said inflatable member bears warning indicia on the surface thereof, and wherein said indicia is substantially concealed when said inflatable member is in said folded condition.

* * * * *